US005611404A

United States Patent [19]

Biek et al.

[11] Patent Number: 5,611,404

[45] Date of Patent: Mar. 18, 1997

[54] HYDRAULIC IMPULSE TOOL WITH ENHANCED FLUID SEAL

[75] Inventors: Paul A. Biek, Houston; Albert J. Kachich, Katy, both of Tex.

[73] Assignee: GPX Corp., Las Vegas, Nev.

[21] Appl. No.: 535,919

[22] Filed: Sep. 28, 1995

[51] Int. Cl.[6] ..... B25B 19/00

[52] U.S. Cl. ..... 173/1; 173/93.5

[58] Field of Search ..... 173/1, 93.5, 93, 173/208

[56] References Cited

U.S. PATENT DOCUMENTS

| | | | |
|---|---|---|---|
| 2,900,812 | 8/1959 | DeSelms | 64/28 |
| 3,263,426 | 8/1966 | Skoog | 60/54.5 |
| 3,998,443 | 12/1976 | Webb | 267/125 |
| 4,307,784 | 12/1981 | Smith | 173/12 |
| 4,359,107 | 11/1982 | Smith | 173/12 |
| 4,553,948 | 11/1985 | Tatsuno | 464/25 |
| 4,740,144 | 4/1988 | Biek | 418/266 |
| 4,767,295 | 8/1988 | Biek | 418/151 |
| 4,789,373 | 12/1988 | Adman | 464/25 |
| 4,836,296 | 6/1989 | Biek | 173/93.5 |
| 4,920,836 | 5/1990 | Sugimoto et al. | 173/93.5 |
| 4,967,852 | 11/1990 | Tatsuno | 173/93.5 |
| 5,080,181 | 1/1992 | Tatsuno | 173/93.5 |
| 5,092,410 | 3/1992 | Wallace et al. | 173/93.5 |
| 5,531,279 | 7/1996 | Bick | 173/93.5 |

FOREIGN PATENT DOCUMENTS 1002262 8/1965 United Kingdom .

OTHER PUBLICATIONS

Patent Cooperative Treaty Search Report, PCT/US96/12879 dated Sep. 25, 1996.

*Primary Examiner*—Scott A. Smith
*Attorney, Agent, or Firm*—Baker & Botts, L.L.P.

[57] ABSTRACT

An impulse tool (10) including an impulse generator (19, 119) utilizes an enhanced seal to reduce leakage of hydraulic fluid. The annular clearance in the pressure plate (24, 124) is sealed around the spindle (30, 130) with a resilient seal (38, 138). A primary passage (40, 140) through the pressure plate is provided to compensate for expansion of the fluid. The use of the primary passage (40, 140), which is not susceptible to enlargement due to wear, minimizes pressure peaks in the accumulator reservoir (42, 142), and results in less leakage.

13 Claims, 2 Drawing Sheets

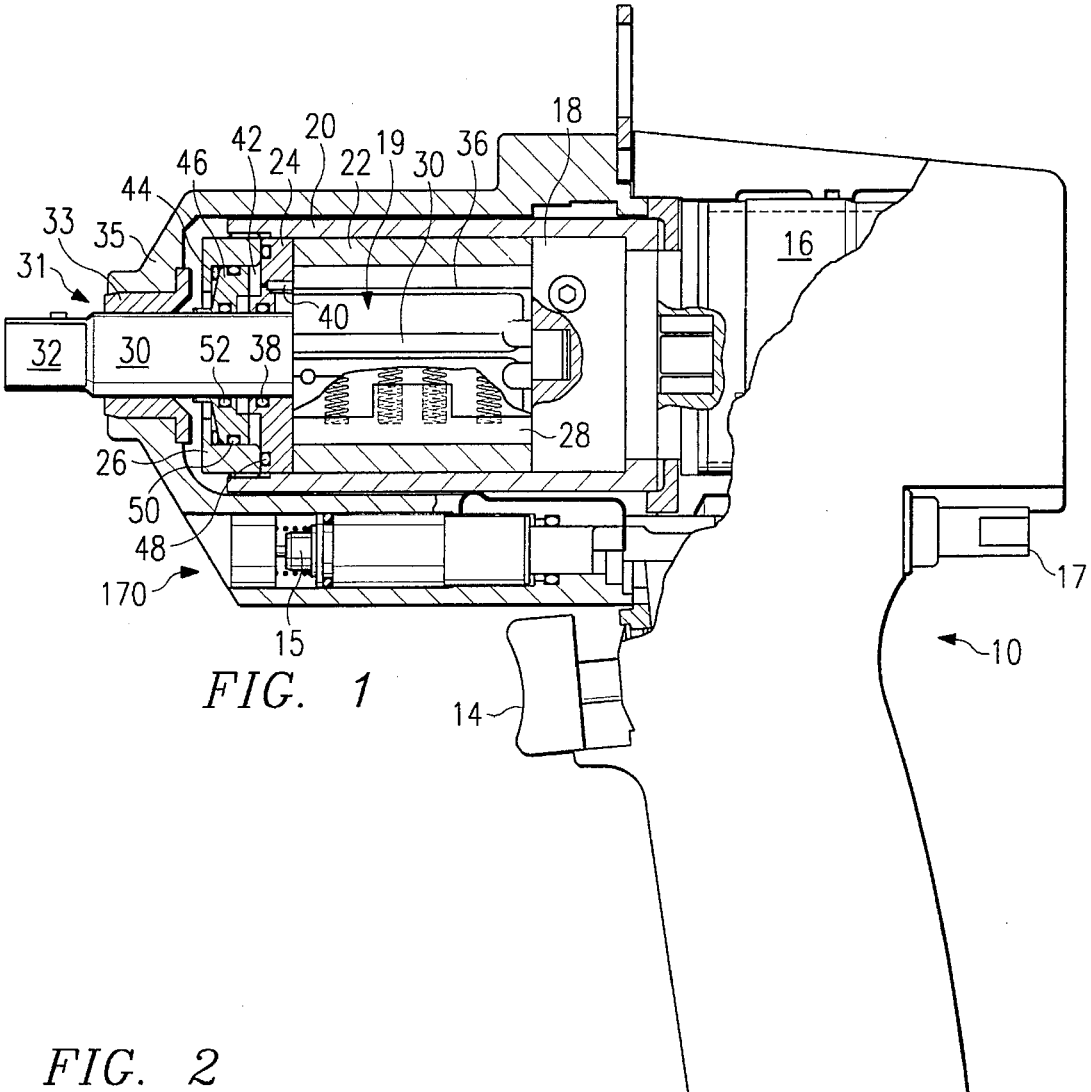
FIG. 1
FIG. 2
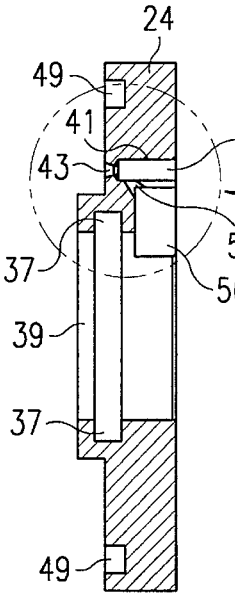
FIG. 3
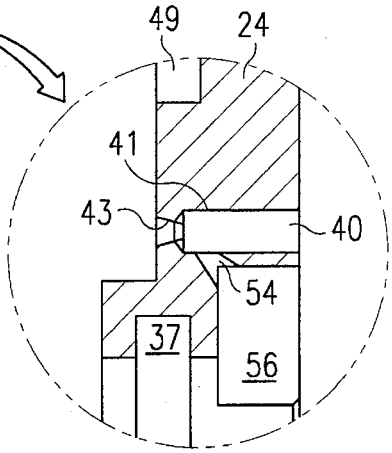

FIG. 4
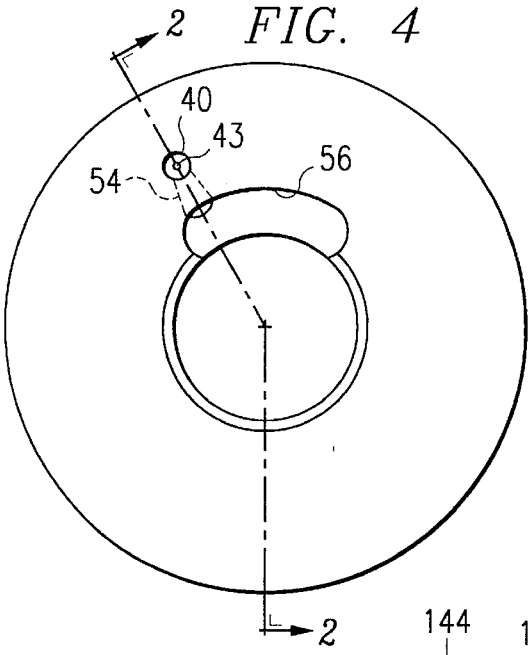
FIG. 5
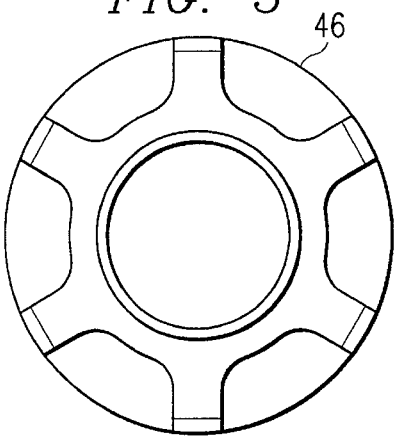
FIG. 6
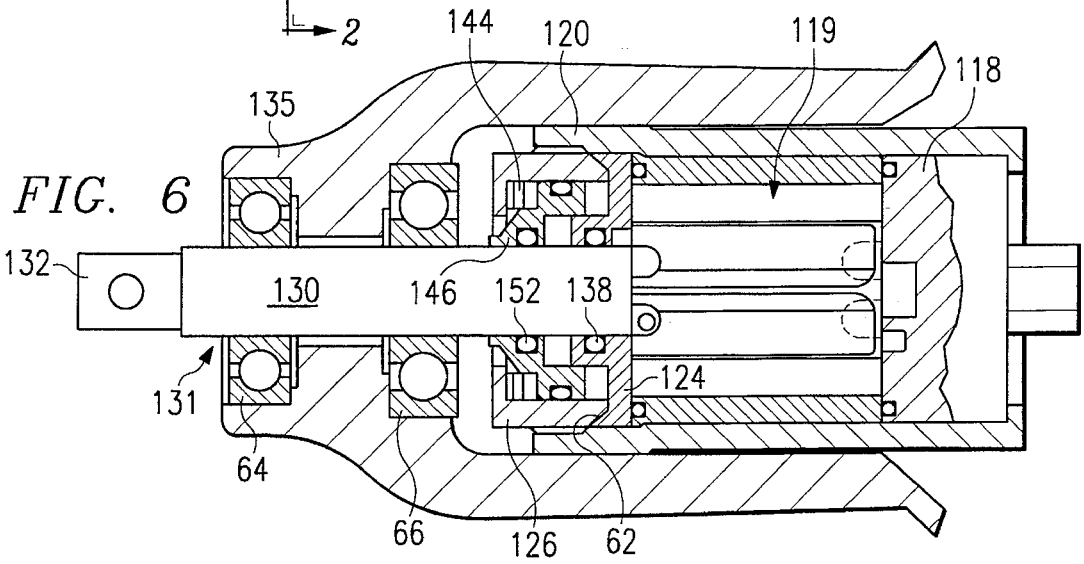
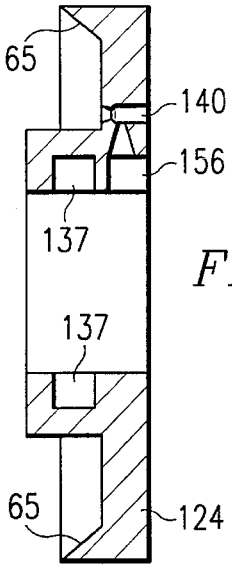
FIG. 7

HYDRAULIC IMPULSE TOOL WITH ENHANCED FLUID SEAL

TECHNICAL FIELD OF THE INVENTION

This invention relates in general to the field of impulse tools, and more particularly to a tool with enhanced fluid seals.

BACKGROUND OF THE INVENTION

For many years rotary torque impulse units have been used to tighten threaded fasteners. A radial vane air motor is often used to power such impulse units. A typical rotary torque impulse unit includes a sealed fluid chamber filled with oil or other suitable hydraulic fluid. At one end of the fluid chamber, a spindle shaft protrudes through a pressure plate. Leakage from the fluid chamber must be minimized to maintain the desired output from the torque unit. During operation of the impulse unit oil will heat and expand in volume. Therefore, an accumulator reservoir is often provided to allow for expansion of the oil or hydraulic fluid and to provide a resupply of lost oil. Examples of such hydraulic impulse units are shown in U.S. Pat. No. 4,836,296, entitled "Fluid Pressure Impulse Nut Runner" and U.S. Pat. No. 4,789,373, entitled "Hydraulic Torque Impulse Generator."

For an impulse unit that utilizes an accumulator reservoir to function properly, a small amount of fluid must be allowed to pass from the fluid chamber to the accumulator reservoir to compensate for expansion of the oil due to the increased temperature. Flow of the fluid into the accumulator reservoir must be severely limited, however, to prevent oil pressure peaks from being transmitted into the accumulator reservoir. To accomplish this, prior art units have utilized a nonresilient annular clearance seal between the spindle shaft and the pressure plate. This clearance surrounding the spindle shaft is necessarily small in area in order to prevent substantial oil pressure peaks from being transmitted into the accumulator reservoir. As some grinding clearances are a practical requirement of manufacturer, and as some wear of metal parts occurs during normal service, the clearance around the spindle shaft increases with use of the tool. This increased clearance eventually allows oil pressure peaks of sufficient magnitude to be transmitted to the accumulator reservoir. These pressure peaks may cause the inner and outer seals of the accumulator piston to flex, causing leakage through minute irregularities and scratches on the accumulator sealing surfaces. This flexing also may cause leakage in a pumping fashion as the pressure peaks occur in the fluid.

As a result of this wear and resulting leakage, current units require regular maintenance, approximately every 250,000 fasteners tightened or removed. This maintenance includes disassembling the tool, refilling the fluid chamber with oil, and reassembling the tool. Another problem with currently existing models is that it is difficult to purge air bubbles from the oil in the chamber during refilling of the unit.

SUMMARY OF THE INVENTION

In accordance with the present invention disadvantages and problems associated with previous rotary torque impulse units have been substantially reduced or eliminated. The present invention provides an enhanced fluid seal system to substantially reduce or eliminate any leakage of oil from the impulse unit.

According to one aspect of the present invention, a resilient seal is mounted within the pressure plate encircling the spindle output shaft and a small passage is provided through the pressure plate outside of the largest diameter of the pulse spindle body to provide appropriate fluid communication between the fluid chamber and accumulator reservoir. This restrictive passage minimizes pressure peaks from occurring within the accumulator reservoir, yet provides a passage for volumetric expansion of the oil in the fluid chamber. The passage also allows the accumulator to replenish small amounts of lost oil due to leakage.

Unlike many of the annular clearance seal of prior art units, the passage is not susceptible to enlargement by wear. Therefore, the unit retains its seal much more consistently over the life of the tool. By using the present invention, the period of use between maintenance may be increased by more than 50 percent. This allows the user to tighten or remove over 350,000 fasteners between maintenance periods.

According to another aspect of the present invention, a secondary passage is provided joining the small passage to a slot within the pressure plate. This secondary passage is useful in purging air bubbles during refilling of the unit. The passage also allows for dissipation of pressure peaks during operation of the tool in the reverse direction.

BRIEF DESCRIPTION OF THE DRAWINGS

For a more complete understanding of the present invention, and the advantages thereof, reference is now made to the following description taken in conjunction with the accompanying drawings, in which:

FIG. 1 is a side view in partial cross section of an impulse tool forming a first embodiment of the present invention;

FIG. 2 is a sectional view of the pressure plate 24 of FIGS. 1 and 4 taken along line 2—2;

FIG. 3 is a detail view of a portion of the pressure plate 24 shown in FIG. 2;

FIG. 4 is an end view of pressure plate 24;

FIG. 5 is an end view of an annular accumulator piston 46;

FIG. 6 is a cross-sectional view of a portion of a tool forming a second embodiment of the present invention; and FIG. 7 is a cross-sectional view of the pressure plate 124 of FIG. 6.

DETAILED DESCRIPTION OF THE INVENTION

The present invention and its advantages are best understood by referring to FIGS. 1–7 of the drawings, like numerals being used for like and corresponding parts of the various drawings.

The present invention may be used with any impulse-driven rotary tool such as an impact wrench. For purposes of illustration, the embodiments are presented in the context of a nut runner. Referring to FIGS. 1–3, nut runner or tool 10 has a pistol-like configuration with an inlet port 12 to power the unit and an exit port 13. The inlet 12 will typically provide the connection between the unit and a compressed air source. The particular embodiment shown includes a shut-off mechanism 15 and a direction selector 17, which allows the tool to be operated in the forward direction for installing a fastener or the reverse direction for removing a fastener.

A trigger mechanism 14 controls the flow of compressed air from inlet 12 to a radial vane motor 16. The radial vane motor 16 rotates a rotary torque impulse generator 19. Rotary torque impulse generator 19 includes a base cap 18, casing 20, cage 22, pressure plate 24, end cap 26, and sealed fluid chamber 36, which all rotate in unison as one part. Periodically a rotary torque impulse is delivered to pulse blades 28 and to a spindle 30, causing spindle 30 to rotate. Spindle 30 is rotatably mounted at one end in base cap 18, and is rotatably supported at the nose 31 of tool 10 by bushing 33, which is coupled to an outer tool casing 35. The other end of spindle 30 may be a square drive 32 which is used to tighten the fastener. Spindle 30 extends through aperture 39 of pressure plate 24. Fluid is contained within sealed fluid chamber 36. Fluid chamber 36 has generally elliptical cross section when two pulse blades are used, but is generally cylindrical with one blade. The boundaries of fluid chamber 36 are defined by base cap 18, cage 22, pressure plate 24, and resilient seal 38. Fluid chamber 36 and pulse blade 28 are arranged such that the rotation of base cap 18, casing 20, cage 22, pressure plate 24, and end cap 26 create high and low pressure regions within fluid chamber 36, resulting in a rotary torque impulse which is transmitted to pulse blade 28 and spindle 30. Generation of a rotary torque impulse using one or two pulse blades in a fluid chamber to turn a spindle in this fashion is described in detail in U.S. Pat. No. 4,836,296, entitled "Fluid Pressure Impulse Nut Runner, " which is incorporated herein by reference for all purposes.

Resilient seal 38 is positioned in groove 37 within pressure plate 24. Resilient seal 38 and groove 37 encircle aperture 39 in pressure plate 24, through which spindle 30 protrudes. Resilient seal 38 rotatably seals the pressure plate 24 to spindle 30, thereby closing off the annular clearance passage therebetween. This resilient seal 38 not only prevents pressure pulses from being transmitted through the annular clearance passage formed when spindle 30 is inserted into aperture 39, but also substantially eliminates leakage of fluid through aperture 39.

To compensate for the expansion of the fluid due to temperature increases from operation of the impulse tool 10 or any other reason, primary passage 40 through pressure plate 24 is provided which places fluid chamber 36 in fluid regulated communication with accumulator reservoir 42. Primary passage 40 may be formed as shown in FIG. 2, and detailed in FIG. 3. A small hole 41 is drilled in pressure plate 24 from the side adjacent to fluid chamber 36, protruding almost through pressure plate 24. As shown in FIG. 3, a smaller hole 43 is then punched through pressure plate 24 from the opposite side (the side adjacent to accumulator reservoir 42). Hole 43 may be approximately 0.020 inches in diameter, or may be adjusted for various sized impulse tools, such that hole 43 is large enough to allow a small flow of fluid to compensate for temperature changes, yet small enough to prevent pressure pulses from being transmitted from fluid chamber 36 to accumulator reservoir 42.

During normal use of the impulse tool, the temperature of the fluid in fluid chamber 36 increases. As the fluid expands due to the increased temperature, it flows from the fluid chamber 36 through the primary passage 40 into an accumulator reservoir 42. Fluid in the accumulator reservoir 42 is kept slightly pressurized (compared to ambient pressure) by a biasing means, such as a solid elastomeric spring 44, which provides pressure on an annular accumulator piston 46. Fluid is sealed within the accumulator reservoir 42 by resilient seal 48, end cap 26, pressure plate 24, resilient seal 50, which seals the annular accumulator piston 46 to the end cap 26, and by resilient seal 52, which seals the annular accumulator piston 46 to the spindle 30. As tool 10 cools after use and the fluid contracts, the pressure from spring 44 acting on the annular accumulator piston 46 causes the fluid to return through the primary passage 40 from the accumulator reservoir 42 to the fluid chamber 36.

A secondary passage 54 communicates between the primary passage 40 and a slot 56, which may be kidney-shaped (see FIG. 4), in the pressure plate 40. The secondary passage 54 allows for dissipation of pressure peaks during reverse operation of the impulse unit 10. The slot 56 is a lower pressure region. Secondary passage 54 has the additional advantage of allowing air to escape from the fluid chamber 36 during refilling of the tool 10. This reduces difficulties encountered in many prior units with purging air bubbles from the sealed unit.

The location of slot 56 within the pressure plate 24, as well as the relative location of primary passage 40 and secondary passage 54, is shown for one embodiment in FIG. 4. The configuration of the annular accumulator piston 46 is shown in FIG. 5.

A second embodiment of the present invention is shown in FIGS. 6 and 7. This embodiment may be most effectively utilized in small impulse tools. This embodiment is analogous to the first embodiment in most respects (corresponding parts have the same last two digits as the reference numerals shown for the first embodiment). In this embodiment, spindle 130 is rotatably supported at the nose 131 by outer bearing 64 and inner bearing 66, which are secured to outer tool casing 135. This second embodiment also utilizes a coiled flat wire spring 144, which provides pressure on the annular accumulator piston 146. A metal-to-metal seal 62 between end cap 126 and pressure plate 124 is utilized in place of seal 48 and groove 49. Metal-to-metal seal 62 includes a first sealing surface 63 on end cap 126 and a second sealing surface 65 on pressure plate 124 as shown in FIGS. 6 and 7.

Although the present invention and its advantages have been described in detail, it should be understood that various changes, substitutions and alterations can be made herein without departing from the spirit and scope of the invention as defined by the appended claims.

What is claimed is:

1. An impulse unit, comprising:

a rotary torque impulse generator including a fluid chamber, the fluid chamber comprising:

a base cap, a cage coupled to the base cap, and a pressure plate formed with an aperture therethrough and coupled to the cage;

a spindle having one or more impulse receiving pulse blades extending into the fluid chamber through the aperture in the pressure plate;

a resilient seal mounted on the pressure plate adjacent the aperture, for preventing transmission of transient pressure peaks outside the fluid chamber and preventing leakage of fluid through the aperture for the spindle in the pressure plate;

an accumulator reservoir defined outside of the fluid chamber operable to allow volumetric expansion of the fluid and to replenish lost oil due to leakage;

the pressure plate formed with a primary restrictive passage therethrough, the primary restrictive passage located in and extending through the pressure plate remote from the aperture for the spindle and communicating on one side thereof with the fluid chamber and on the other side thereof with the accumulator reservoir, the primary passage operable to minimize pressure peaks within the accumulator reservoir; and an accumulator piston partly defining the accumulator reservoir, forming a boundary between the accumulator reservoir on one side and the atmosphere on the other, the piston operable to adjust the volume of the accumulator reservoir in relation to occurring volume changes in the hydraulic fluid during operation of the impulse unit.

2. The impulse unit of claim 1, wherein the accumulator reservoir comprises:

an end cap which concentrically surrounds the spindle; and the accumulator piston, which is movably guided in the end cap.

3. The impulse unit of claim 2, wherein the accumulator piston further comprises at least one outer seal ring at its outer periphery for cooperation with the end cap and at least one inner seal ring at its inner periphery for cooperation with the spindle to substantially seal off any fluid flow therebetween.

4. The impulse unit of claim 2, further comprising a biasing means for urging the accumulator piston toward the pressure plate to compensate for decreasing volume in the accumulator reservoir.

5. The impulse unit of claim 1, further comprising a spring means for biasing the annular accumulator piston toward the pressure plate.

6. The impulse unit of claim 5, wherein the spring means comprises an elastomeric spring.

7. The impulse unit of claim 5, wherein the spring means comprises a coiled flat wire spring.

8. The impulse unit of claim 1, further comprising:

a recessed slot in the pressure plate;

a secondary restrictive passage operable to dissipate pressure peaks during reverse operation; and the secondary restrictive passage communicating on one side thereof with the primary restrictive passage and on the other side thereof with the recessed slot in the pressure plate.

9. The impulse unit of claim 8, wherein the recessed slot further comprises a kidney-shaped configuration.

10. A rotary torque tool having an impulse unit and a motor, comprising:

a fluid chamber having a pressure plate;

a motor;

a drive member coupled to the motor;

a spindle having one or more impulse receiving pulse blades extending into the fluid chamber through an aperture in the pressure plate, a portion of the spindle associated with the drive member;

fluid retaining means associated with a portion of the spindle and arranged to divide the fluid chamber into at least one high-pressure compartment and at least one low-pressure compartment during a limited portion of a relative rotation between the drive member and the pulse spindle, thereby producing transient port impulse generating pressure peaks in the at least one high pressure compartment;

a resilient seal mounted on the pressure plate adjacent the spindle for preventing transmission of transient pressure peaks outside the fluid chamber and preventing leakage of fluid through the aperture for the spindle in the pressure plate;

an accumulator reservoir defined outside of the fluid chamber operable to allow volumetric expansion of the fluid and to replenish lost oil due to leakage;

a primary restrictive passage operable to minimize pressure peaks within the accumulator reservoir, the primary restrictive passage located in and extending through the pressure plate remote from the aperture for the spindle and communicating on one side thereof with the fluid chamber and on the other side thereof with the accumulator reservoir; and an accumulator piston partly defining the accumulator reservoir, forming a boundary between the accumulator reservoir on one side and the atmosphere on the other, the piston operable to adjust the volume of the accumulator reservoir in relation to occurring volume changes in the hydraulic fluid during operation of the impulse unit.

11. A method for manufacturing an impulse unit comprising the steps of:

forming a fluid chamber that includes a base cap, a cage coupled to the base cap, and a pressure plate with a spindle-receiving aperture formed therethrough;

disposing a spindle within the fluid chamber such that a portion of the spindle extends through the aperture in the pressure plate and the portion of the spindle is coupled to the base cap of the fluid chamber;

coupling an impulse generator to the spindle within the fluid chamber;

placing a resilient seal on the pressure plate adjacent the spindle to form a substantially leakproof seal between the spindle and the pressure plate;

forming an accumulator reservoir with a pressure regulating means; and forming a primary passageway through the pressure plate to place the fluid chamber in restricted fluid communication with the accumulator reservoir to minimize pressure peaks being transmitted from the fluid chamber to the accumulator reservoir while allowing adjustment of the fluid in response to volumetric changes.

12. The method of claim 11 wherein the step of forming a primary passage comprises the steps of:

drilling a hole substantially through the pressure plate with a first diameter;

punching a second hole with a second diameter in the pressure plate connecting one side of the pressure plate with the first hole, the second diameter sized less than the first diameter of the first hole.

13. The method of claim 11 wherein the step forming an accumulator reservoir with a pressure regulating means further comprises the step of forming one portion of the accumulator reservoir to have a biasing surface responsive to volume decreases to thereby hold a substantially consistent pressure in the accumulator reservoir.

* * * * *